US005081910A

United States Patent [19]

D'Ascenzo, Jr.

[11] Patent Number: 5,081,910

[45] Date of Patent: Jan. 21, 1992

[54] LOCKING LINEAR ACTUATOR

[76] Inventor: Frank D'Ascenzo, Jr., 2015 Bellaire, Royal Oak, Mich. 48067

[21] Appl. No.: 707,425

[22] Filed: May 28, 1991

Related U.S. Application Data

[63] Continuation of Ser. No. 507,675, Apr. 10, 1990, abandoned.

[51] Int. Cl.[5] ..... F15B 15/26

[52] U.S. Cl. ..... 92/20; 92/23; 92/14; 92/15; 92/28; 92/DIG. 4

[58] Field of Search ..... 92/14, 15, 17, 18, 20, 92/21, 22, 23, 24, 25, 29, DIG. 4, 169.1

[56] References Cited

U.S. PATENT DOCUMENTS

| | | | |
|---|---|---|---|
| 1,42,776 | 1/1932 | Bogoslowsky | 92/25 |
| 1,740,683 | 12/1929 | Gartin | 92/15 |
| 1,781,697 | 11/1930 | Nilson et al. | 92/15 |
| 2,074,772 | 3/1937 | Brown | 92/24 |
| 2,170,757 | 8/1939 | Holloway | 92/23 |
| 2,185,564 | 1/1940 | Parker | 92/15 |
| 2,773,485 | 12/1956 | Geyer . | |
| 2,811,951 | 11/1957 | Boden et al. . | |
| 2,815,005 | 12/1957 | Geyer . | |
| 2,886,008 | 5/1959 | Geyer et al. . | |
| 2,918,786 | 12/1959 | Geyer . | |
| 2,970,573 | 7/1961 | Geyer . | |
| 2,974,638 | 3/1961 | Chase | 92/25 |
| 3,107,582 | 10/1963 | Royster | 92/24 |
| 3,217,609 | 11/1965 | Royster | 92/24 |
| 3,534,621 | 10/1970 | D'Ascenzo . | |
| 3,576,151 | 4/1971 | Sendoykas . | |
| 3,668,977 | 6/1972 | Beidler . | |
| 3,732,783 | 5/1973 | Emenaker . | |
| 3,763,747 | 10/1973 | Beichel et al. . | |
| 3,783,976 | 1/1974 | Kerr | 92/15 |
| 3,799,036 | 3/1974 | Slaughter | 92/24 |
| 4,196,654 | 4/1980 | Stearns . | |
| 4,214,795 | 7/1980 | Kakuminato | 92/25 |
| 4,462,768 | 7/1984 | Westmoreland . | |
| 4,471,686 | 9/1984 | Garlapaty | 92/22 |

FOREIGN PATENT DOCUMENTS

| | | | |
|---|---|---|---|
| 1426540 | 11/1968 | Fed. Rep. of Germany | 92/15 |

*Primary Examiner*—Edward K. Look
*Assistant Examiner*—Thomas Denion
*Attorney, Agent, or Firm*—Krass & Young

[57] ABSTRACT

A power cylinder assembly including means to positively lock the piston rod of the assembly in the forward extended position of the cylinder assembly. The locking means includes a pair of cam plates that are moved radially outwardly into locking engagement with lock slots defined by inserts positioned in the wall of the cylinder with the radially outward movement of the locking plates being generated by a lost motion connection between the piston and the piston rod in the form of a pin and slot connection. The pin is carried by the piston rod and coacts with cam slots in the cam plates to move the cam plates radially outwardly at the end of the forward stroking movement of the piston assembly so that the final forward movement of the piston generates the radially outward movement of the lock plates.

17 Claims, 4 Drawing Sheets

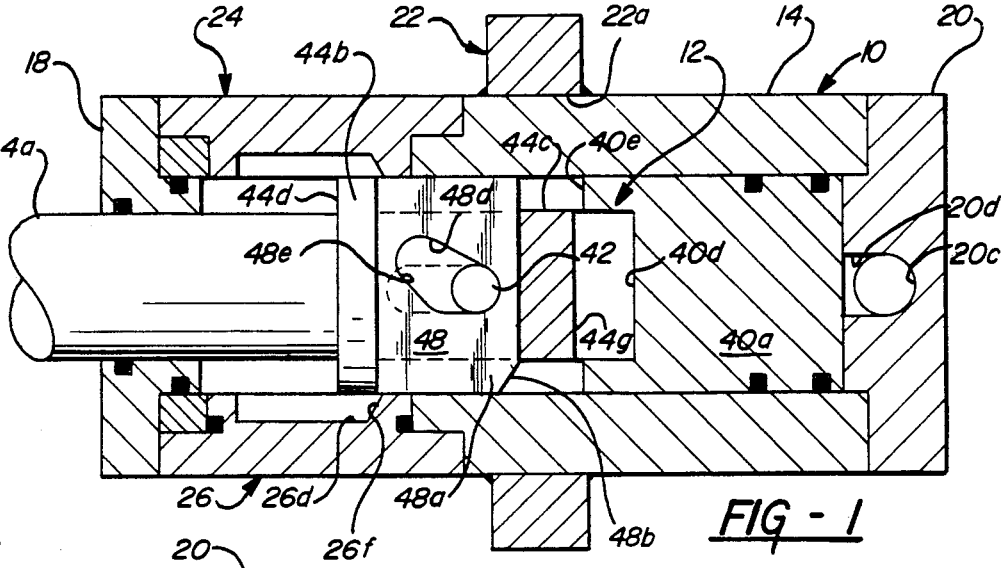
FIG - 1
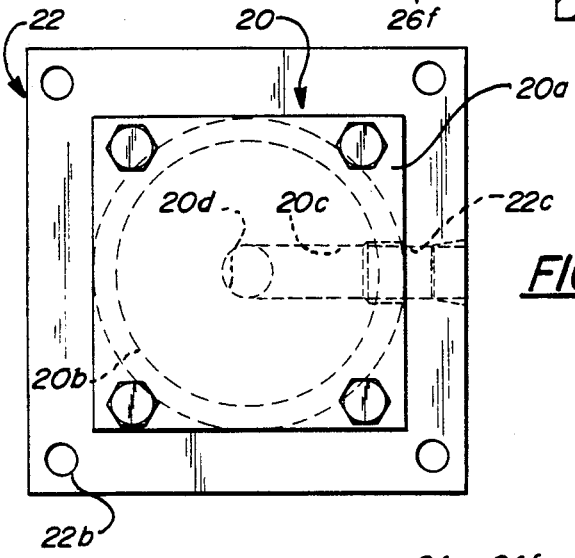
FIG - 4
FIG - 2
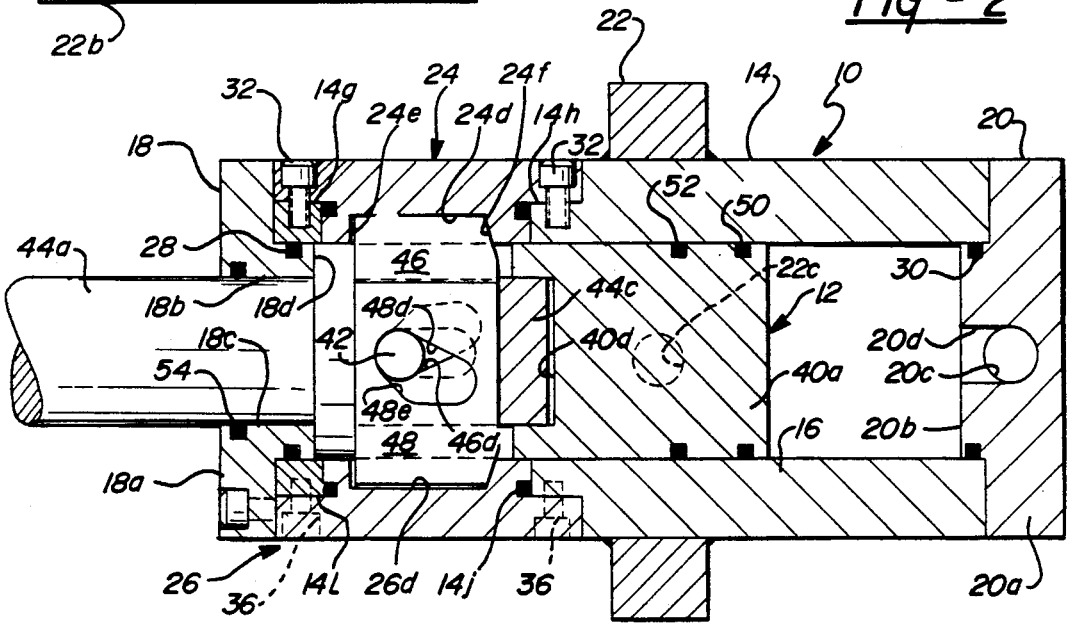

LOCKING LINEAR ACTUATOR

This is a continuation of co-pending application Ser. No. 507,675 filed on Apr. 10, 1990 now abandoned.

BACKGROUND OF THE INVENTION

This invention relates to power cylinders operated by fluid pressure and more particularly to a fluid pressure operated power cylinder including means to securely lock the piston rod of the cylinder in a desired position.

Power cylinders, either pneumatically actuated or hydraulically actuated, find many applications in modern industry. For example, power cylinders are utilized to advance the slide of a tool head in a machine tool so as to bring the cutting tool to a position to operate on a workpiece. If the piston is not locked in its position of adjustment, the associated tool may bounce back and forth or chatter when it is moved against and into the work. As a further example, power cylinders are also conventionally used to operate work holding clamps. It is essential in these situations that the cylinder hold the workpiece securely and that it maintain a holding force on the work sometimes for long periods of time. As a further example, power cylinders are used in association with the die of an injection molding apparatus to alternately open and close the die during its operating cycle. It is important in these and other applications that the power cylinder include means to ensure that the piston, and thereby the associated tool or clamp, maintains its position of adjustment irrespective of forces exerted against the associated tool or clamp and irrespective of pressure losses in the cylinder.

Various devices have been proposed to allow the piston rod to be locked in a desired position. However, all of the prior art devices suffer from the disadvantages that they are either unduly complicated and expensive and/or do not effectively maintain the piston rod in its locked disposition.

SUMMARY OF THE INVENTION

The present invention is directed to the provision of a power cylinder having an improved piston lock arrangement.

According to the invention, the power cylinder includes a cylinder having a sealed central axial bore and inlet and outlet ports communicating with the bore and a piston assembly including a piston mounted for axial movement in the bore in response to the selective introduction of pressurized hydraulic fluid into the bore through the ports, a piston rod having a lost motion connection to the piston and extending out of the bore through one end of the cylinder, and lock means carried by the piston assembly within the bore and movable radially outwardly in response to lost motion movement between the piston and the piston rod to lock the piston rod relative to the cylinder. This arrangement provides a simple, compact, and inexpensive means of locking the piston rod relative to the cylinder.

According to a further feature of the invention, the lock means is positioned between the piston and the end wall of the cylinder through which the piston rod extends. This arrangement provides a compact overall cylinder assembly.

According to a further feature of the invention, the lost motion connection comprises a pin and slot connection between the piston and the piston rod and the lock means comprises first and second plate members each having a cam slot passing the pin of the pin and slot connection. This arrangement provides a compact and efficient packaging of the piston rod and lock members.

According to a further feature of the invention, the cam slots of the first and second plate members present oppositely disposed cam surfaces for coaction with the pin of the pin and slot connection so that the plates move outwardly in opposite radial directions in response to the lost motion movement between the piston and the piston rod.

According to a further feature of the invention, the lock means comprises a lock member defining a radially outer edge portion and the cylinder includes means defining a recess in the cylindrical wall of the cylinder opening into the cylinder bore and sized to lockingly receive the radially outer edge portion of the lock member. This arrangement provides a means of effectively locking the piston rod relative to the cylinder while preserving the integrity of the internal cylindrical surface of the bore.

According to a further feature of the invention, the recess defining means comprises an insert sealingly received in an opening in the wall of the cylinder and defining the recess at its inner surface. This arrangement provides an inexpensive and effective means of providing the locking recess at the inner surface of the bore.

In the disclosed embodiment of the invention, the first and second plate members are carried by the piston assembly and are arranged to move radially outwardly in opposite direction in response to lost motion movement occurring between the piston and piston rod upon arrival of the piston at its forward extended position. The radially outer edges of the plate members are moved respectively into locking slots defined by inserts positioned in diametrically opposed openings in the cylinder wall so as to positively lock the piston rod relative to the cylinder.

BRIEF DESCRIPTION OF THE DRAWING

FIG. 1 is a cross-sectional view of the invention power cylinder with the piston assembly shown in a retracted position;

FIG. 2 is a cross-sectional view similar to FIG. 1 but showing the piston assembly in a forward extended position and locked with respect to the cylinder;

FIG. 4 is an end view of the invention power cylinder;

DETAILED DESCRIPTION OF THE PREFERRED EMBODIMENT

Figure 3:
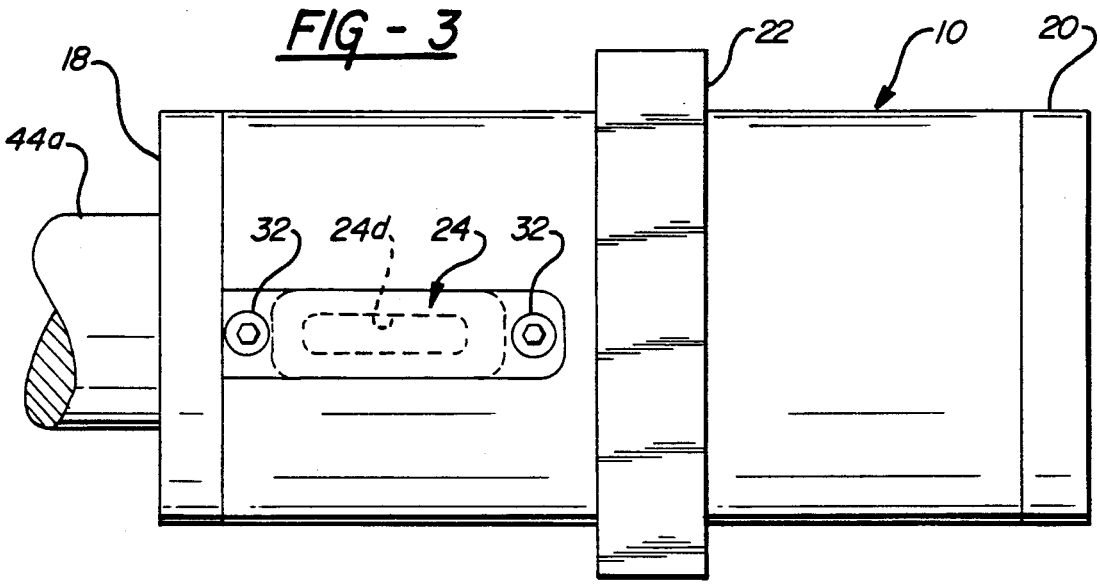
FIG. 3 is a top view of the invention power cylinder.
Figure 7:
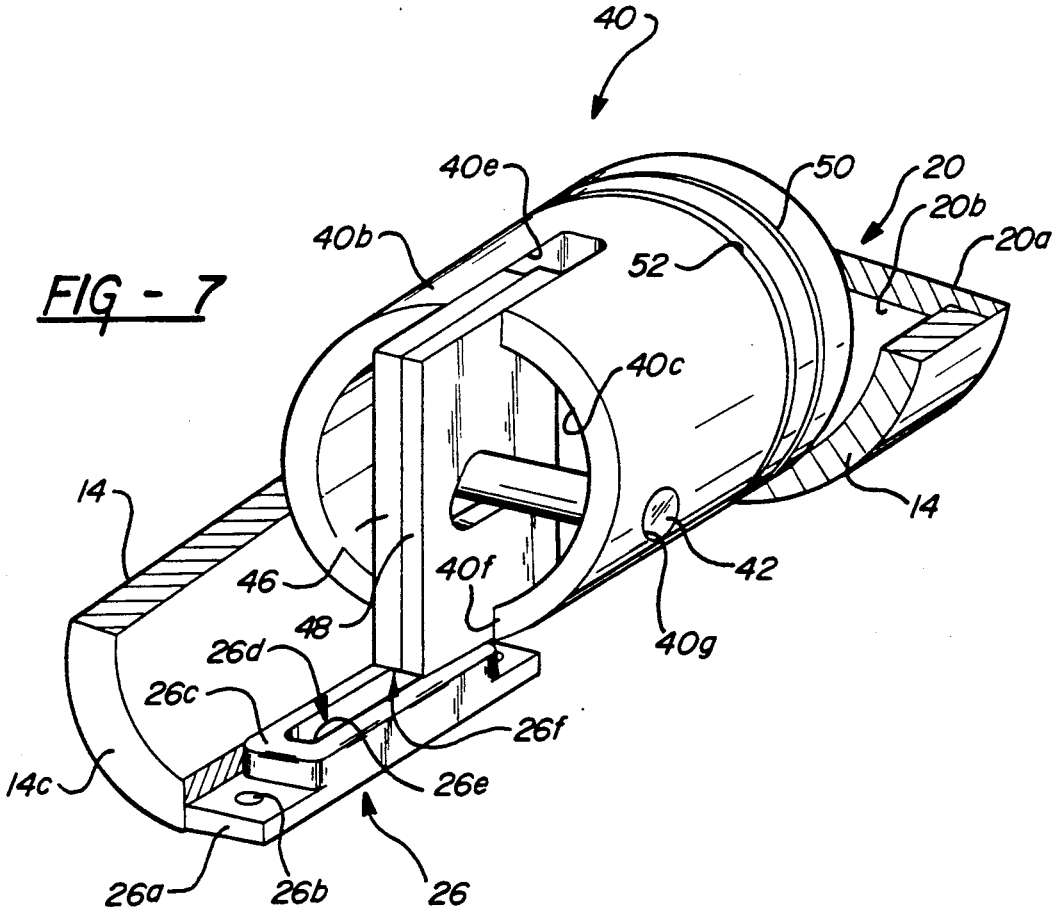
FIG. 7 is a fragmentary perspective view showing portions of the piston assembly in association with portions of the cylinder.
Figure 5:
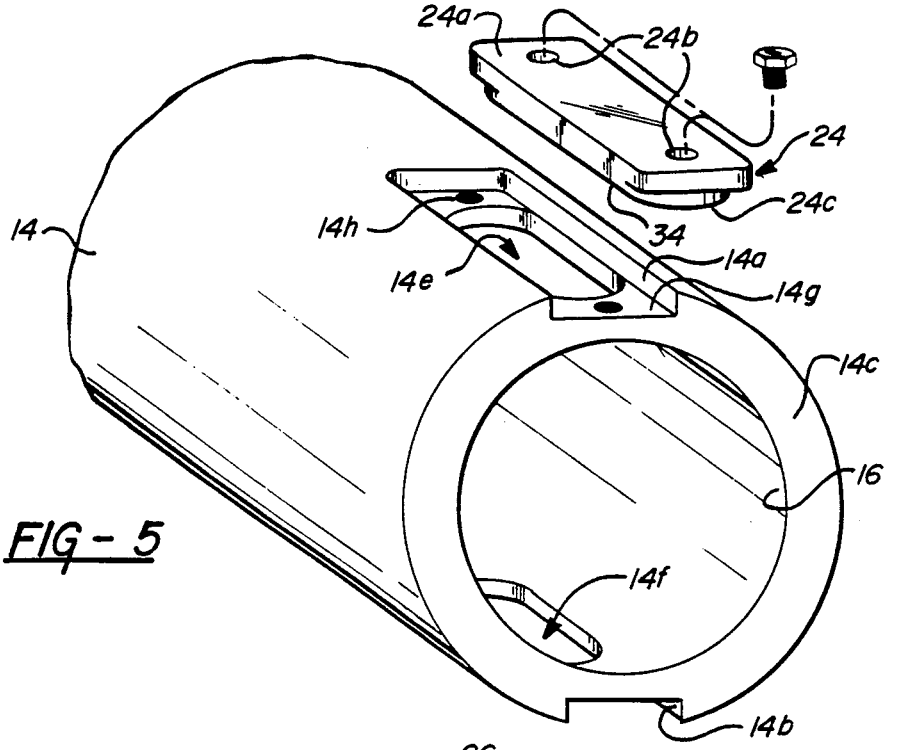
FIG. 5 is a fragmentary perspective view of the cylinder assembly of the invention power cylinder.
Figure 6:
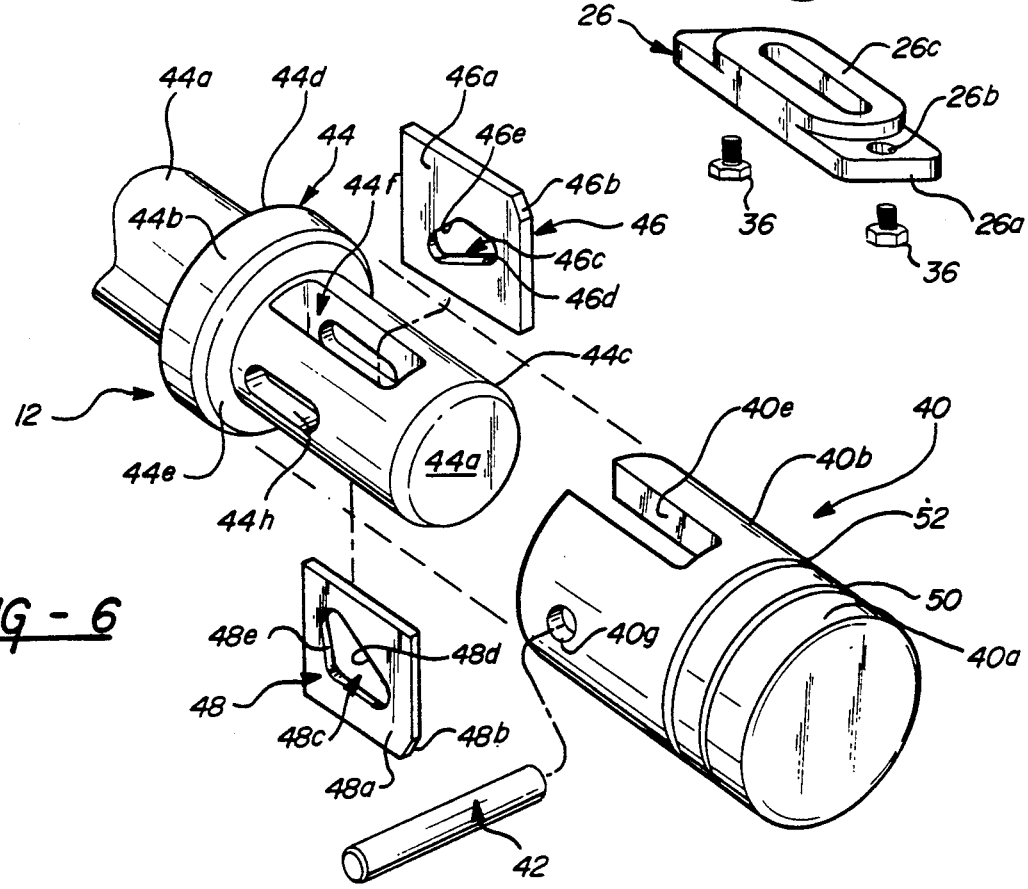
FIG. 6 is an exploded perspective view of the piston assembly of the invention power cylinder.

The invention power cylinder assembly, broadly considered, includes a cylinder assembly 10 and a piston assembly 12.

Cylinder assembly 10 includes a main body cylindrical member 14 defining an axially extending cylindrical bore 16; a front end wall member 18; a rear end wall member 20; a flange 22; and a pair of inserts 24,26.

Main body cylindrical member 14 includes a pair of diametrically opposed axially extending slots 14*a*,14*b* opening in the forward annular end edge 14*c* of the cylindrical member and also opening in the outer circumferential surface 14*d* of the cylindrical member. An elongated through aperture 14*e* extends from slot 14*a* and opens into bore 16 and elongated aperture 14*f* extends from slot 14*b* and opens into bore 16. Aperture 14*e* is of lesser axially extent than slot 14*a* so as to define shoulders 14*g* and 14*h* forwardly and rearwardly of aperture 14*e*, and aperture 14*f* is of lesser axial extent than slot 14*b* so as to define shoulders 14*i* and 14*j* forwardly and rearwardly of aperture 14*f*.

Front end wall member 18 includes a main body portion 18*a*, defining a central bore 18*b*, and a hub portion 18*c* sized to fit into the open front end of bore 16 and sealing with that bore via an O-ring 28 received in a suitable circumferential seal groove in hub portion 18*c*.

Front end wall member 18 thus seals the forward end of bore 16.

Rear end wall member 20 includes a main body rectangular portion 20*a* and a central hub portion 20*b* received in the open rear end of bore 16 and sealing with bore 16 via an O-ring 30 carried in a circumferential seal groove on hub portion 20*b* so that rear wall end member 20 10 seals the rear end of bore 16. A hydraulic fluid port 20*c* extends radially through main body portion 20*a* for communication with a radially extending port 20*d* so as to provide hydraulic fluid communication between the exterior of the cylinder assembly and bore 16 proximate the rear end of the bore.

Flange 22 has a rectangular external configuration with a central circular opening 22*a* and is suitably secured to the main body cylinder member 14, intermediate the ends of the cylinder assembly, as for example by welding. Flange 22 includes a plurality of mounting holes 22*b* at the four corners of the flange to facilitate mounting of the cylinder assembly and further defines a radially extending port 22*c* communicating with and aligned with a radial port 14*k* in cylinder member 14 so as to provide a further port communicating between the exterior of the cylinder assembly and bore 16 at a location intermediate the ends of the bore.

Inserts 24 and 26 are identical and are positioned respectively in slots 14*a* and 14*b* in the cylindrical member 14. Insert 24 includes a main body rectangular portion 24*a* sized to fit snugly in slot 14*a* and including a pair of front and rear mounting holes 24*b* and a lock portion 24*c* having a size and configuration so as to fit snugly in opening 14*e*. Lock portion 24*c* defines a radially inwardly opening axially extending slot 24*d* having a right angled front end face 24*e* and an angled or beveled rear end face 24*f*. Insert 24 is secured in position in the wall of cylindrical member 14 by a pair of screw bolts 32 passing downwardly through holes 24*b* for threaded engagement with blind threaded bores in shoulders 14*g* and 14*h* with an O-ring 34 carried by lock portion 24*c* sealingly engaging with opening 14*e* in the cylinder wall to preserve the sealed integrity of bore 16. The outer peripheral surface of main body portion 24*a* is made suitably arcuate to match the external periphery of the wall of cylindrical member 14 so as to preserve the cylindrical integrity of the exterior surface of the cylinder assembly and the radially inner surface of lock portion 24*c* has an arcuately concave configuration matching the curvature of bore 16 so as to preserve the cylindrical integrity of the bore 16.

As noted, insert 26 is identical to insert 24 and includes a main body portion 26*a* having mounting holes 26*b* and a lock portion 26*c* defining a slot 26*d* having a right angled front end wall 26*e* and an angled or beveled front end wall 26*f*. Insert 26 is mounted in slot 14*b* in the wall of cylindrical member 14 in diametrically opposed relation to insert 24 by screw bolts 36 passing through apertures 26*b* for threaded engagement with blind threaded bores in shoulders 14*i* and 14*j* of cylindrical member 14 with an O-ring 38 carried on lock portion 26*c* maintaining the sealed integrity of bore 16. As with insert 24, insert 26 is suitably arcuately contoured on its outer and inner surfaces to match the outer and inner cylindrical configurations of cylindrical member 14 so as to preserve the cylindrical integrity of the outer surface of the cylinder assembly as well as the cylindrical integrity of bore 16.

Piston assembly 12 includes a piston 40, a pin 42, a piston rod 44, and a pair of lock plates 46,48.

Piston 40 is sized to fit slidably and sealingly in bore 16 and includes a rear solid portion 40*a*, defining a pair of circumferential seal grooves for receipt of O-rings 50 and 52, and a forward hollow portion 40*b* opening toward the front end of the cylinder assembly. Hollow portion 40*b* defines a bore 40*c* opening forwardly of the piston and extending rearwardly to a transverse end wall 40*d*. A pair of axially extending forwardly opening slots 40*e* and 40*f* are provided in hollow portion 40*b* at diametrically opposed locations and a pair of holes 40*g* are provided in the cylindrical wall of hollow portion 40*b* on a plane at right angles to the plane of slots 40*e* and 40*f*. Slots 40*e* and 40*f* have a thickness approximating the combined thickness of lock plates 46 and 48 and have a length approximating the axial extent of plates 46,48.

Pin 42 is received in apertures 40*g* in piston hollow portion 40*b* so as to extend transversely and diametrically across the bore 40*c* defined by hollow piston portion 40*b*.

Piston rod 44 includes a forward portion 44*a* for connection to a suitable machine or workpiece, a central collar portion 44*b*, and a rear portion 44*c*. It will be understood that forward portion 44*a* would include means, not shown, to facilitate the coupling of the piston rod to a suitable machine or workpiece. Collar portion 44*b* has a diameter approximating the diameter of bore 16 and of piston 40 and defines a front annular shoulder 44*d* with forward portion 44*a* and a rear annular shoulder 44*e* with rear portion 44*c*. Forward portion 44*a* is slidably received in central bore 18*b* of forward end wall member 18 with an O-ring 54 carried by member 18 sealingly engaging piston rod portion 44*a* so as to preserve the sealed integrity of bore 16.

Rearward piston rod portion 44*c* has a cylindrical size and shape designed to fit slidably in the bore 40*c* of piston hollow portion 40*b* and includes a central slot 44*f* extending diametrically through rear portion 44*c* and extending axially from a location proximate shoulder 44*e* to a location spaced forwardly from the rear end face 44*g* of piston rear portion 44*c*. Slot 44*f* has a width approximating the combined thickness of lock plates 46,48 (and thereby a width corresponding to the width of piston slots 40*e*,40*f*) and has an axial extent somewhat greater than the axial extent of lock plates 46,48. Piston forward portion 44*c* further defines a pair of diametrically opposed axially plane of slots 44*f* and coinciding with the plane of pin 42. Slots 44*h* have a width slightly exceeding the diameter of pin 42 so as to slidably receive pin 42.

Locking plates 46 and 48 are identical but, in operative relation within the piston assembly, are mounted so as to move in opposite directions.

Plate 46 has a generally rectangular configuration with an upper edge portion 46*a* including a beveled or angled forward surface 46*b*. Plate 46 further includes a cam slot 46*c* sized to receive pin 42 and including angled cam surfaces 46*d*,46*e* for camming coaction with pin 42. Similarly, plate 48 includes an upper portion 48*a* including a forward angled or beveled surface 48*b* and further includes a cam slot 48*c* including cam surfaces 48*d*,48*e* for camming coaction with pin 42.

Plates 46,48 have a height approximating the diameter of piston 40 and of bore 16 and an axial extent corresponding to the axial extent of insert slots 24*d*,26*d* and corresponding to the axial extent of slot 44*f* in piston rod rear portion 44*c*.

In the assembled relation of the invention cylinder assembly, piston assembly 12 is received in bore 16 with O-rings 50, 52 and 54 maintaining the sealed integrity of the bore 16; piston rod rear portion 44*c* is telescopically received in bore 40*c* of piston forward portion 40*b*; lock plates 46 and 48 are received in piston rod slot 44*f* and in slots 40*e*,40*f* of piston forward portion 40*b*; and pin 42 is received in opposed apertures 40*g* in piston 40 and passes through a slot 44*h* in the piston rod, through cam slots 46*c*,48*c* of the cam plates, through the other slot 44*h* of the piston rod, and through the other aperture 40*g* in the piston. Plates 46,48 are oppositely arranged so that the cam surfaces 46*d*,48*d* and 46*e*,48*e* are angularly but oppositely disposed with respect to the path of pin 42 so that the plates are moved radially inwardly and outwardly in opposite directions in response to relative movement between the pin 42 and the cam plates.

In operation, it will be seen that plates 46,48 move into and out of locking coaction with slots 24*d*,26*d* as the piston moves reciprocally within the bore 16 of the cylinder assembly. Specifically, as the piston assembly moves from the retracted position of FIG. 1 to the working position of FIG. 2 in response to the introduction of pressurized hydraulic fluid through port 20*c*,20*d* and venting of hydraulic fluid through port 14*b*,22*c* the piston and piston rod move as a unit with the piston rod being driven by the piston through the intermediary of the pin 42 driving the cam surfaces 46*e*,48*e* of the cam plates to thereby drive the cam plates and the piston rod forwardly with the piston with the pin 42 being precluded from shifting its relationship within the cam slots 46*c*,48*c* by virtue of the engagement of the outer edge portions 46*a*,48*a* of the cam plates with the wall of the bore 16. As the piston assembly arrives at the fully extended position as seen in FIG. 2, the cam plates are free to move radially outwardly into the slots 24*d*,26*d* so that, as the collar portion 44*b* of the piston rod engages the rear annular edge 19*d* of front end wall hub portion 18*c*, the forward movement of the piston rod ceases and the continued forward movement of the piston acts through the intermediary of cam 40 riding up on cam surfaces 46*e*,48*e* to move the cam plates radially outwardly into locking engagement with the cam slots 24*d*,26*d* defined by inserts 24,26. The piston rod is thus held firmly in its extended position, irrespective of changes in the pressure of the fluid in bore 16 or even in the absence of any such pressure, by the locking engagement of the outer edge portions 46*a*,48*a* with the inserts 24 and 26 so that the piston rod is effectively isolated from the piston and from the hydraulic fluid within the piston so that a workpiece or apparatus controlled by the piston rod will be firmly and rigidly maintained in position for so long as is necessary to perform the operation of the associated apparatus or to perform the required operation on the associated workpiece.

When it is desired to retract the cylinder assembly, pressure fluid is vented through port 20*c*,20*d* and pressure fluid is introduced through port 14*k*,22*c* so as to tend to urge the piston assembly rearwardly within bore 16. The initial portion of the rearward movement of the piston is taken up by the lost motion provided by the pin and slot connection defined by pin 42 and slots 46*c*,48*c*, and, specifically, as pin 42 moves rearwardly with the piston it engages cam surfaces 46*c*,48*d* to move the outer edge portions 46*a*,48*a* of the cam plates radially inwardly out of engagement with slots 24*d*,26*d* with the radially inward movement of the outer edge portions of the cam plates being facilitated by the angled forward portions 46*b*,48*b* of the upper edges of the lock plates coacting with the angled forward wall portions 24*f*,26*f* of the lock slots. As soon as the cam plates have moved radially inwardly to a position within the dimensions of bore 16 and begin to move forwardly within the bore 16, the pin 14 is locked with respect to the cam slots and the piston rod is thereafter moved rearwardly with the piston to the retracted position seen in FIG. 1.

Figure 8:
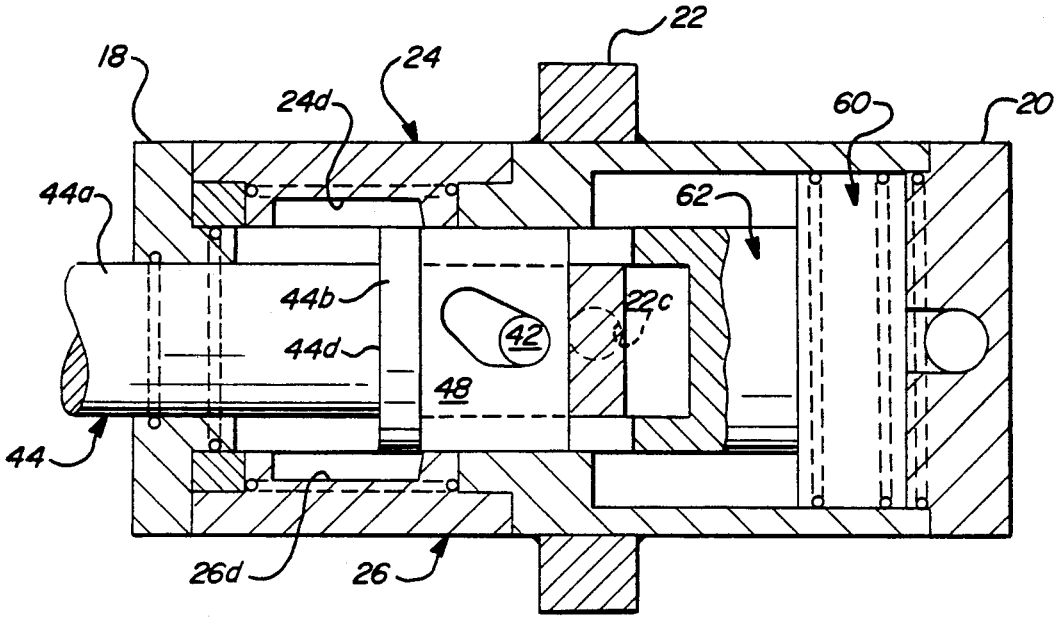
FIG. 8 is a cross-sectional view of a modified form of power cylinder assembly according to the invention with the piston assembly shown in a retracted position.
Figure 9:
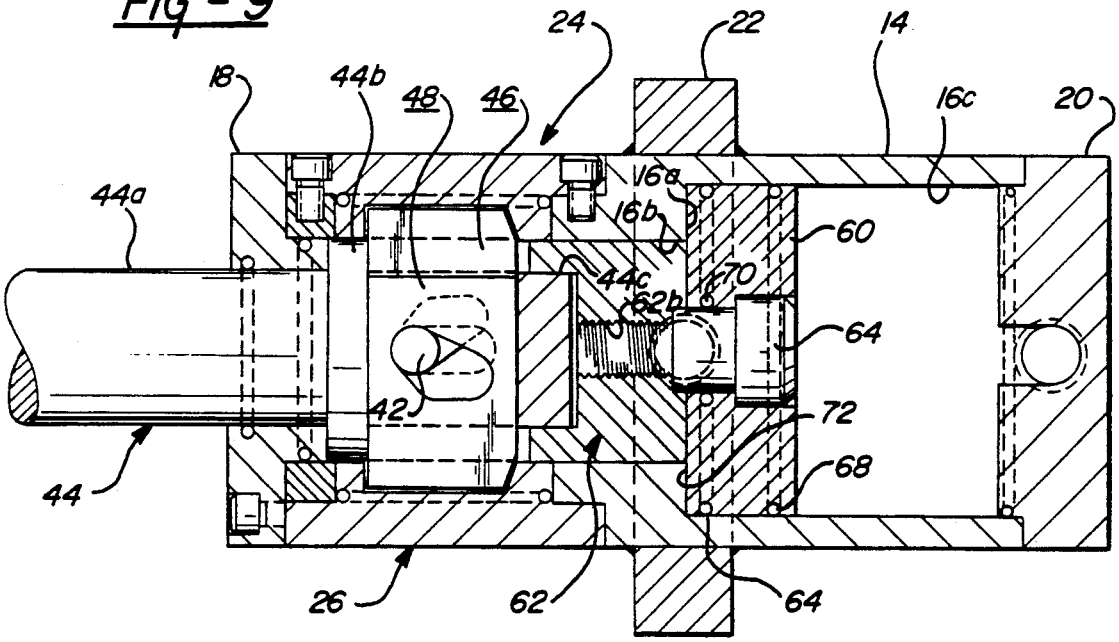
FIG. 9 is a cross-sectional view of the power cylinder of FIG. 8 with the piston assembly shown in a forward extended position and with the piston assembly locked with respect to the cylinder.

The alternate embodiment of the invention seen in FIGS. 8 and 9 is identical to the embodiment of FIGS. 1–7 with the exception that the inner periphery of cylindrical member 14 is stepped outwardly at 16*a* to define a relatively small diameter forward bore portion 16*b* and a relatively large diameter rearward bore portion 16*a* and the piston is a two-part construction including a relatively large diameter member 60 slidably mounted in large diameter bore portion 16*c* and a relatively small diameter piston member 62 mounted in relatively small diameter bore portion 16*b* and secured to piston member 60 by a screw 64 passing through member 60 for threaded engagement with a threaded central bore 62*a* in member 62. Member 60 is sealed with respect to bore portion 16*c* by O-ring 66 and 68 and screw 64 is sealed with respect to member 60 by an O-ring 70. The embodiment of FIGS. 8 and 9 has the advantage of providing a larger forward piston area, represented by the annular area 72 defined at the juncture of piston members 60 and 62, so as to provide a greater force for moving the piston assembly between its retracted and extended positions.

The described cylinder assembly will be seen to provide a compact and efficient power cylinder which is effectively and positively locked in its forward extended position so as to isolate the associated workpiece or apparatus from the internals of the cylinder assembly and so as to ensure that the associated apparatus or workpiece will be maintained in position during the desired operation of the associated apparatus or during the desired work step to be performed on the associated workpiece.

Whereas preferred embodiments of the invention have been illustrated and described in detail, it will be apparent that various changes may be made in disclosed embodiment without departing from the scope or spirit of the invention.

I claim:

1. A power cylinder assembly comprising:

a cylinder having sealed central axial bore, inlet and outlet ports communicating with said sealed bore, and slots in the cylindrical wall of said sealed bore opening regularly inwardly into the sealed bore; and a piston assembly positioned in said sealed bore and including a piston mounted for axial movement in said bore in response to the selective introduction of pressurized hydraulic fluid into said bore through said ports, a piston rod having a lost motion connection to said piston within said bore and extending sealingly out of said bore through one end wall of said cylinder, and lock means carried by said piston assembly within said bore and including a pair of flat lock plates mounted in confronting side-by-side relation in said sealed bore and means operative to move said plates radially outwardly in opposite directions within said bore, in response to lost motion movement between said piston and said piston rod, into locking engagement with said slots to lock said piston rod relative to said cylinder.

2. A cylinder according to claim 1 wherein:

said lock means is positioned between said piston and said one end wall of said cylinder.

3. A cylinder according to claim 2 wherein:

said lost motion connection comprises a pin and slot connection between said piston and said piston rod; and said lock means comprises cam slots in said locking plates passing the pin of said pin and slot connection.

4. A cylinder according to claim 3 wherein:

the cam slots of said first and second plate members present oppositely disposed cam surfaces for coaction with said pin so that said plates move outwardly in opposite radial directions in response to the lost motion movement between said piston and said piston rod.

5. A cylinder according to claim 1 wherein:

each of said lock plates defines a radially outer edge portion sized to lockingly seat in said slots.

6. A cylinder according to claim 1 wherein:

each of said lock plates defines a radially outer edge portion; and said slots comprise diametrically opposed recesses in the cylindrical wall of said cylinder opening into said bore at diametrically opposed locations and sized to respectively lockingly receive and radially outer edge portions of said lock plates.

7. A power cylinder assembly comprising:

a cylinder including an axially extending main body cylindrical portion, front and rear end wall portions coacting with said main body portion to define a sealed axial cylindrical bore extending continuously and uninterruptedly between said front and rear end wall portions, inlet and outlet ports communicating with said sealed bore, and slots in the cylindrical wall of said sealed bore opening radially inwardly into said sealed bore;

a piston mounted for axial movement in said bore, in response to the selective introduction of pressurized hydraulic fluid into said bore through said ports, between a retracted position relatively remote from said front end wall portion and an extended forward position relatively proximate said front end wall portion;

a piston rod connected to the front side of said piston and including a forward portion extending through said forward end wall portion and means defining a radially outwardly extending stop surface for coaction with said forward end wall portion;

a pair of flat lock plates mounted in confronting side-by-side relation in said sealed bore;

means operative in response to movement of said stop surface into abutting engagement with said end wall upon movement of said piston to its extended forward position to move said plates radially outwardly in opposite directions within said bore into locking engagement with said slots to lock said piston rod relative to said cylinder.

8. A cylinder according to claim 7 wherein:

said lock means is positioned between said piston and said forward end wall portion of said cylinder.

9. A cylinder according to claim 8 wherein:

said piston and said piston rod are connected by a lost motion connection; and said plates are movable radially outwardly in response to lost motion movement occurring between said piston and said piston rod as said piston moves to its extended forward position.

10. A cylinder according to claim 9 wherein:

said lock plates each have a cam slot; and said lock motion connection comprises a pin and slot connection between said piston and said piston rod including a pin carried by the piston passing through the cam slots in the lock plates.

11. A cylinder according to claim 10 wherein:

the cam slots of said first and second plate members present oppositely disposed cam surfaces for coaction with said pin so that said plates move outwardly in opposite radial directions in response to the lost motion movement between said piston and said piston rod.

12. A power cylinder assembly comprising:

a cylinder having a sealed central axial bore and inlet and outlet ports communicating with said bore; and a piston assembly positioned in said sealed bore and including a piston mounted for axial movement in said bore in response to the selective introduction of pressurized hydraulic fluid into said bore through said ports, a piston rod having a lost motion connection to said piston within said bore and extending sealingly out of said bore through one end wall of said cylinder, and lock means carried by said piston assembly within said bore and including a pair of flat lock plates mounted in confronting side-by-side relation in said sealed bore and means operative to move said plates radially outwardly in opposite directions within said bore, in response to lost motion movement between said piston and said piston rod, to lock said piston rod relative to said cylinder;

said locking means being positioned between said piston and said one end wall of said cylinder;

said lost motion connection comprising a pin and slot connection between said piston and said piston rod;

said lock means comprising cam slots in said locking plates passing the pin of said pin and slot connection;

the cam slots of said pair of lock plates presenting oppositely disclosed cam surfaces for coaction with said pin so that said plates move outwardly in opposite radial direction in response to the lost motion movement between said piston and said piston rod;

said piston including a solid rearward and a hollow forward portion;

said piston rod including a rearward portion telescopically receive in the forward hollow portion of said piston and including an axially extending pin slot; and said pin being carried by said hollow forward portion of said piston and passing through said pin slot in said rearward portion of said piston rod.

13. A cylinder according to claim 12 wherein:

said forward piston portion includes forwardly opening axially extending plate slot means;

said rearward piston rod portion includes an axially extending plate slot aligned with said plate slot means in said piston forward portion; and said plate members are positioned in said aligned slots and slot means with said pin passing through the cam slots of said plate members.

14. A power cylinder assembly comprising:

a cylinder having a sealed central axial bore and inlet and outlet ports communicating with said bore;

a piston assembly including a piston mounted for axial movement in said bore in response to the selective introduction of pressurized hydraulic fluid into said bore through said ports, a piston rod having a lost motion connection to said piston and extending out of said bore through one end of said cylinder, and lock means carried by said piston assembly within said bore and including a lock member movable radially outwardly in response to lost motion movement between said piston and said piston rod and defining a radially outer edge portion; and an insert sealingly received in an opening in the wall of said cylinder and defining a recess at its inner surface opening into said bore and sized to lockingly receive said radially outer edge portion of said lock member to lock said piston rod relative to said cylinder.

15. A power cylinder assembly comprising:

a cylinder having a sealed central axial bore and inlet and outlet ports communicating wi·' said bore;

a piston assembly including a piston mounted for axial movement in said bore in response to the selective introduction of pressurized hydraulic fluid into said bore through said ports, a piston rod having a lost motion connection to said piston and extending out of said bore through one end of said cylinder, and lock means carried by said piston assembly within said bore and including first and second lock members arranged to move radially outwardly in respective opposite radial directions in response to lost motion movement between said piston and said piston rod and each defining a radially outer edge portion; and inserts sealingly received in diametrically opposed openings in the wall of said cylinder and respectively defining recesses at their inner surfaces opening into said bore and sized to respectively lockingly receive said radially outer edge portions of said lock members to lock said piston rod relative to said cylinder.

16. A power cylinder assembly comprising:

a cylinder including an axially extending main body cylindrical portion, front and rear end wall portions coacting with said main body portion to defining an axial cylindrical bore, and inlet and outlet ports communicating with said bore;

a piston mounted for axial movement in said bore, in response to the selective introduction of pressurized hydraulic fluid into said bore through said points, between a retracted position relatively remote from said front end wall portion and an extended forward position relatively proximate said front end wall portion;

a piston rod connected to the front side of said piston and extending through said forward end wall portion;

lock means including a lock member movable radially outwardly in response to movement of said piston to its extended forward position and defining a radially outer edge portion; and an insert sealingly received in an opening in the wall of said cylinder and defining a recess at its inner surface opening into said bore and sized to lockingly receive said radially outer edge portion of said lock member to lock said piston rod relative to said cylinder.

17. A power cylinder assembly comprising:

a cylinder including an axially extending main body cylindrical portion, front and rear end wall portions coacting with said main body portion to defining an axial cylindrical bore, and inlet and outlet ports communicating with said bore;

a piston mounted for axial movement in said bore, in response to the selective introduction of pressurized hydraulic fluid into said bore through said points, between a retracted position relatively remote from said front end wall portion and an extended forward position relatively proximate said front end wall portion;

a piston rod connected to the front side of said piston and extending through said forward end wall portion;

lock means including first and second lock members arranged to move radially outwardly in respective opposite radial directions in response to movement of said piston to its extended forward position and each defining a radially outer edge portion; and inserts sealingly received in diametrically opposed openings in the wall of said cylinder and respectively defining recesses at their inner surfaces opening into said bore and sized to respectively lockingly receive said radially outer edge portions of said locking members to lock said piston rod relative to said cylinder.

* * * * *